United States Patent [19]

Hembert

[11] Patent Number: 4,925,044

[45] Date of Patent: May 15, 1990

[54] FLUID TANK AND METHOD OF MANUFACTURING IT

[76] Inventor: Claude L. Hembert, Chemin du Fenouillet, 83400 Hyeres les Palmiers, France

[21] Appl. No.: 222,439

[22] Filed: Jul. 21, 1988

[30] Foreign Application Priority Data

Jul. 21, 1987 [FR] France ..... 87 10768
May 24, 1988 [FR] France ..... 88 07256

[51] Int. Cl.[5] ..... F17C 1/06
[52] U.S. Cl. ..... 220/3; 220/465
[58] Field of Search ..... 220/3, 5 A, 453, 454, 220/465

[56] References Cited

U.S. PATENT DOCUMENTS 2,132,761 5/1964 Sylvester ..... 220/3
3,508,677 4/1970 Laibson et al. .
3,843,010 10/1974 Morse et al. .
4,619,374 10/1986 Yavorsky .

FOREIGN PATENT DOCUMENTS 2539191 3/1976 Fed. Rep. of Germany ..... 220/3
2538433 3/1977 Fed. Rep. of Germany ..... 220/3
2301746 9/1976 France .
2600750 12/1987 France .
797480 7/1958 United Kingdom .

*Primary Examiner*—Gerald A. Michalsky
*Attorney, Agent, or Firm*—Browdy and Neimark

[57] ABSTRACT

A high pressure tank, for containing fluid under pressure of the type comprising an internal shell (3) intended to act as a seal and an external shell (4) intended to provide mechanical strength, with the interposition between the two shells of a first cap (5) located on the side forming the bottom and of a second cap (10) located on the side forming the open end of the tank, made in a single piece with a connecting neck (7), is characterized in that the part of the internal shell (3) located on the side forming the open end of the tank (2) is fixed on to the metal piece (6) forming a neck (7) and cap (10) over the entire contact surface (16) between the two components (3, 6), while the outer surface (13) of the cap (10) and part of the exterior surface of the neck (7) are covered by the external shell (4).

12 Claims, 1 Drawing Sheet

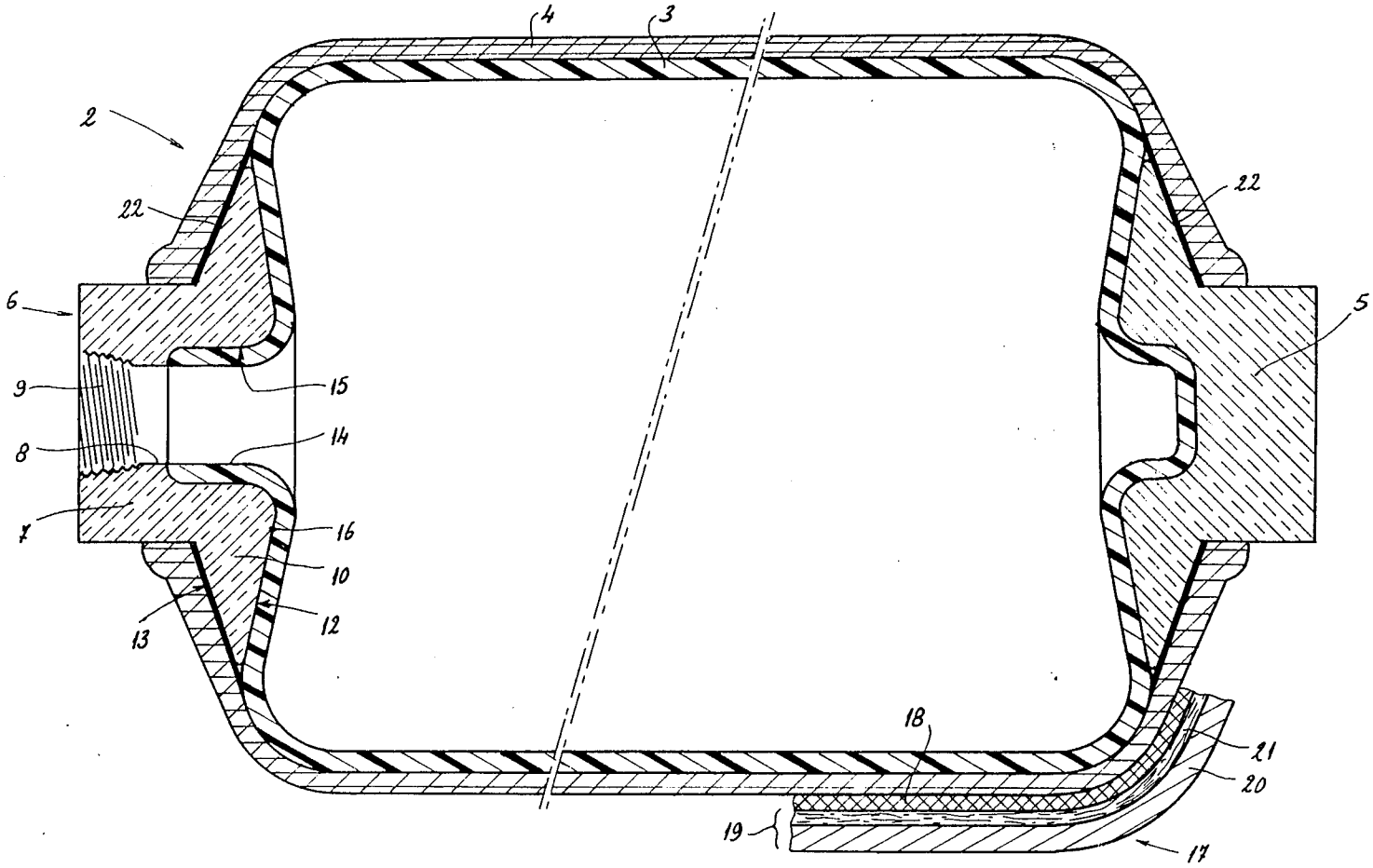
5
22
21
20
17
18
19
3
4
15
14
16
10
12
13
22
2
6
9
8
7

FLUID TANK AND METHOD OF MANUFACTURING IT

The object of the present invention is a tank for any fluid, such as gas at a pressure of the order of 10 to 500 bars (10 to $500\times10^5$ Pa), or an inflammable volatile liquid, or else an hydraulic fluid.

This tank is of the type comprising two concentric shells, namely an internal shell intended to seal off the fluid and an external shell intended to provide mechanical strength.

This mechanical strength is reinforced at the closed end of the container by a cap disposed between the two shells, with which is associated a second piece forming the neck and fitted with means for connection to tubes, pressurereducing valve, cocks, etc.

A tank of this kind is described notably in French Patent 2,301,746. In this tank the cap and the neck have complementary flares directed outwards, permitting a gripping of the open edge of the tank.

A solution of this kind is not satisfactory in view of the fact that in order to ensure the placing of the cap on the open end of the internal shell it is necessary first to deform the open end of this shell, then, after the installation of the cap, to reshape this end so that it will conform in shape to the flared part of the cap.

In addition, this flaring has an adverse effect on sealing properties.

There are also tanks with two concentric shells in which the internal shell is made of a metallic material. These tanks have the disadvantage of being relatively heavy and are, moreover, extremely dangerous in the event of an explosion, since they behave like veritable bombs, scattering metal splinters.

French Patent Application 86 09126 (now FR 2 600750) in the name of the Applicant provides an improved tank in which the neck and the cap, which are located on the side of the open end of the tank are made in a single piece, and in which the internal shell is made of a thermoplastic material. The sealing of this tank is provided by annular joints. Now, these may be defective or may be damaged on installation, which is relatively inconvenient. Thus sealing problems may perist over a prolonged period.

The present invention aims at providing a tank of this type, simple to manufacture and providing an excellent sealing of the interior of the tank without having recourse to sealing elements such as joints.

For this purpose the fluid tank of general cylindrical shape to which it relates and which is of the type comprising an internal shell made of a thermoplastic material intended to provide a seal, and an external shell produced by filament winding and intended to provide mechanical strength, with the insertion between the two shells of a first cap located on the bottom side and a second cap located on the side of the open end of the tank, made in a single piece with a connecting neck, is characterized in that at least the part of the internal shell located on the side of the open end of the tank is fixed by bonding on the metal piece forming the cap and neck over the entire contact surface between these two elements, whereas the outer surface of the cap and part of the outer surface of the neck are covered by the outer shell.

After assembly, the two pieces in question, the cap and the neck on the one hand and the interior shell on the other hand, are completely integral with each other, so that the enclosed volume formed in this way is not subject to risks of leaks due to joints or to a separation between the interior shell and the stiffening insert when the enclosure is subjected to a very high pressure, such as occurs in the case of storing a gas under pressure. These assembled elements impart excellent sealing and mechanical strength to the tank.

The internal face of the neck conveniently has in the zone of it covered by the internal shell, a recess of thickness corresponding substantially to the thickness of the shell.

In this way, when the assembly is in the mounted position, the interior shell is imbedded in the neck, which further improves the bonding and sealing conditions between these two elements.

According to a preferred embodiment which can be applied to all thermoplastic materials capable of being used to construct the internal shell, provision is made for at least the surface of the metal piece intended to be in contact with the shell to be covered, prior to the assembly of these two elements, with a layer of the thermoplastic material of which the internal shell is made permitting securing by adhesive bonding between the said elements.

Preferably, an annular band made of an elastomer material is interposed between the external shell and at least one cap on the inclined surface of the latter so as to reinforce the mechanical bond between these two elements and to permit a certain possibility of radial displacement of the external shell in relation to the cap.

In accordance with one variant, the tank has, over the entire contact surface between the metal piece and the internal shell, a two-component adhesion bonding element composed of a mixture of phenolic epoxy and the thermoplastic material of which the internal shell in question is made.

In the case in which the internal shell is made of a thermoplastic material of the polyamide type, the tank has, over the entire contact surface between the metal piece and the internal shell, a two-component adhesion bonding element composed of a mixture of phenolic epoxy and polyamide.

The assembly made up in this way of these two elements can resist tensile stresses greater than 150 $kgf/cm^2$.

In order to satisfy the safety regulations, which require that in the case of an explosion the tank remains in one piece, and to improve the mechanical strength, the filament winding of which the external shell is made is to advantage a cross winding comprising fibres wound in the two diagonal planes of the cylindrical tank and fibres wound in the direction of the circumference of it, so that the density of fibres at the ends of the cylindrical tank is greater than that at the wall of it.

Preferably, the tank is covered with a fireproof and heatproof coating composed of at least two layers, interior and exterior respectively, the interior layer formed by a sheet of ceramic fibre paper being intended to be attached by one of its faces to the external shell of the tank and to form a thermal barrier, the exterior layer forming a fireproof protection capable of being brought into contact with flames, being composed of a complex glass/glass mat, in which the glass fabric is bonded mechanically to the glass mat, which is itself fixed to the internal layer, this complex being coated or impregnated with a product reinforcing the chemical catalytic effect.

This covering is able to resist fire for a period of more than 30 minutes.

The present invention also relates to a method of manufacturing the tank.

The invention will be better understood and other characteristics will become apparent from the description which follows, with reference to the attached diagrammatical drawing, the sole FIGURE of which shows a longitudinal sectional view of a tank.

As shown in the drawing, the tank, designated by the general reference number 2, which is of general cylindrical shape, comprises an internal shell 3 made, for example, of polyamide, polypropylene or polyethylene, and an external shell 4, made, for example, of epoxy resin reinforced with glass fibre and produced by filament winding.

This tank is fitted in a known manner on the side of its open end with a bottom cap 5, disposed between the internal 3 and external 4 shells and made of a rigid material such as bronze, mechanical stainless steel, aluminium alloy or stainless steel.

At the open end of the tank is disposed a piece 6, preferably made of metal, acting at the same time as neck and cap. For this purpose this piece 6 comprises a tubular section 7 forming the neck and having a central passage 8. The end of the central passage 8 located on the outer side is delimited by a threaded surface 9 permitted the connection of a tube, or a pressure-reducing valve or a cock. The end of the tubular element 7 located on the interior side of the container is extended by a section 10 in the form of a cap, delimited on the side of the inner shell by a surface 12 inclined from the exterior towards the interior and from the open end of the tank towards the closed end of it, and on the side of the external shell 4 by a surface 13 inclined from the interior towards the exterior and from the open end of the tank towards the closed end of it.

The shape of the cap 10 is give here only by way of example; indeed, the surface 12 may also be substantially perpendicular to the axis of the tank 2. It all depends, in fact, on the nature of the material of the piece 6 and the pressure exerted by the fluid which is likely to be contained in the tank.

In this example, and as can be seen from the FIGURE, the bottom cap 5 has a general shape identical with that of the metal piece 6. This permits an economical standardization of the metal pieces 6 and 5 and it is sufficient to bore and tap a cap 5 to obtain a metal piece 6 comprising a central passage 8 delimited by a thread 9.

The internal shell 3 is shaped so as to have a cylindrical neck 14 extending over part of the length of the neck and imbedded in a recess 15 which comprises this, so that after assembly there is a perfect continuity between the interior face of the shell 3 and the interior face of the neck 8.

The surface of the recess 15 and the surface 12 constitute the contact surface 16 between the metal piece 16 and the internal shell 3, which are integral with each other over this entire contact surface 16.

According to a preferred embodiment, it is intended to receive, before the attachment of the shell 3 to the piece 6, a layer of the thermoplastic material of which the internal shell 3 is made, permitting the bonding of these two elements.

In the case in which the shell is made of polyamide, and in a variant embodiment, this bonding may be produced by means of a two-component adhesion element composed of a mixture of a phenolic epoxy resin and polyamide covering the entire contact surface 16. This may, for example, be a mixture of known products marketed under the names "RILPRIM 204" and "RILSAN NATUREL ES4".

In this embodiment "RILPRIM 204" is first applied to the metal piece 6, after which the whole is heated before the projection of the "RILSAN NATUREL ES4" and the integral forming of the shell made of synthetic material, for example inside a mould.

The metal-synthetic material bond produced in this way is able to withstand severe mechanical stresses and assures excellent sealing.

It is clear that the bottom cap 5 may be fixed in the same manner as the piece 6 on the internal shell 3 with a bond which has the characteristics previously described.

The external shell 4 covers the inclined exterior surface 13 of the cap 10 as well as part of the exterior surface of the neck 7. The filament winding making up this external shell 4 is, in fact, a cross winding made in the two diagonal planes of the cylindrical tank 2 and along the circumference of it, so that the density of fibres at the level of the ends of the cylindrical tank 2 is greater than that at the cylindrical wall of it.

This arrangement makes it possible to improve the mechanical strength of the tank and, in the case of bursting due to an excess internal pressure, prevents the disintegration of it into a number of pieces. Indeed, in this illustrative case only a rupture following a limited strip of surface and localized in the cylindrical wall of lower resistance is produced.

In order to ensure a perfect mechanical bonding between the caps 10 and 5 and the external shell 4 while allowing the latter the possibility of moving radially in relation to said caps 10 and 5 in the case of internal excess pressures or reduced pressures on the filling or emptying of the tank, an annular band 22 made of an elastomer material is interposed between the internal shell 4 and each cap 10, 5 on the inclined surface 13 of the latter.

This arrangement makes it possible considerably to reduce the stresses at the level of the two ends of the tank 2.

The fluid tank 2 according to the invention also comprises a fireproof and heatproof protective covering 17, which is shown in part in the drawing, and which comprises two layers, namely an interior layer 18 and an exterior layer 19. The interior layer 18 is a sheet of paper made from ceramic fibres. This sheet 18 has a thickness selected between 0.5 and 5 mm and a very low coefficient of thermal conduction. It is heat-resistant up to temperatures of the order of 1400° C. One of the faces of this interior layer 18 adheres to the external shell 4 and its other face is also assembled by adhesion with the exterior layer 19 of the covering 17. The latter is composed of a fireproof complex comprising glass cloth 20/glass mat 21 assembled mechanically by an means in itself known, in particular by bonding points. The glass mat 21 of the complex 19 is stuck during manufacture on to the interior layer 18, while the glass cloth 20 forms the surface of the covering 17 capable of being exposed to flames.

The complex 19 has a thickness of between 0.9 and 2 mm. It is also previously coated with a urea/esterified formalin resin with a reagent system of the acrylonitrile/acrylate butadiene type in the presence of a catalyst of the thiocyanate type.

This resin is a reinforcement product of the chemical-catalytic effect which makes it possible to increase the non-combustibility of the complex 19.

The adhesive used for the assembly of the interior layer 18 to the exterior layer 19 and to attach the covering 17 to the external shell 4 is a non-inflammable synthetic adhesive, for example a single-component epoxy resin, without solvent, heat-hardenable and resistant to temperatures of above 800° C.

The covering 17 has a thickness of 5 to 6 mm and is able to conform to all shapes on account of its suppleness.

The process for manufacturing the tank in the preferred embodiment described below by way of example consists in first cleaning and degreasing the metal piece 6 by means of an organic solvent such as acetone and then degassing it in a furnace heated to about 300° C. in order completely to eliminate the greases and the solvent.

A layer of the thermoplastic material of which the said shell 3 is made is then applied at least to the surface 16 of the metal piece 6 intended to be in contact with the internal shell 3. This application may be made by projecting the thermoplastic material or by immersing the piece 6 in a hot fluidized bath of said material.

The metal piece 6 and the cap 5 located at the bottom of the tank 2 are then disposed at the ends of a mould of the internal shell 3 forming part of a rotational moulding device, in itself known, in which the mould is rotated on the one hand about its own axis and on the other hand about an axis at right-angles to the said mould axis.

The mould is then heated, while the thermoplastic material in question, which had previously been introduced into the mould, is melted in the latter so as to produce the internal shell 3 by moulding.

It should be noted that the means of heating the mould are concentrated at each of the ends of it so that the heating temperature of these ends is greater than that of the central part of it connecting said ends.

This makes it possible to compensate the high thermal inertia of the metal piece 6 and the cap 5 and to obtain in this way a substantially uniform temperature throughout the mould.

After a certain time necessary for the coating of it, the cylindrical internal shell 3 is removed from the mould and a filament winding is then effected round it, following its two diagonal planes and following its circumference in order to produce the exterior shell 4.

As is obvious, the invention is not limited merely to the embodiments of the tank and merely to the manufacturing process described above by way of examples: on the contrary, it covers all variants of embodiment and application.

I claim:

1. Fluid tank generally cylindrical in shape, of the type comprising an internal shell (3) made of thermoplastic material and intended to act as a seal and an external shell (4) made by filament winding and intended to provide mechanical strength, with the interposition between the two shells of a first cap (5) located at a bottom of the tank and a second cap (10) located at an open end of the tank, made in a single metal piece (6) with a connecting neck (7), characterized in that at least the part of the internal shell (3) located on the side of the open end of the tank (2) is fixed to the metal piece (6) forming the neck (7) and cap (10) over an entire contact surface (16) between the two elements (3, 6), while the external surface (13) of the cap (10) and a part of an exterior surface of the neck (7) are covered by the external shell (4), and in that it is covered by a fireproof and heatproof protective covering composed at least two layers, interior (18) and exterior (19), the interior layer (18) being formed by a sheet of paper made of ceramic fibres and being intended to be fixed by one of its faces to the external shell (4) of the tank (2) and to form a thermal barrier, the exterior layer (19) being composed of a glass cloth (20)/glass mat (21) complex forming a fireproof protection capable of being brought into contact with flames, said glass cloth (2) being mechanically bonded to the glass mat (21), which is itself fixed to the interior layer (18), this complex (19) being provided with a product reinforcing a chemical catalytic effect.

2. A tank for containing fluid under elevated pressure on the order of 10–500 bars, comprising:

a generally cylindrical external shell (4) of filament winding reinforced material having high mechanical strength and having a first end and a second end;

a first metal cap (5) secured partly within said external shell (4) at said first end and closing said first end and having an inner wall;

a second metal cap (6) having an axial bore therethrough with an inner end and an outer end, said second cap being secured partly within said external shell at said second end and having an inner wall;

seal means for sealing said tank to prevent escape of fluid therefrom and being capable of resisting tensile stresses greater than 150 kgf/cm$^2$, said seal means comprising an internal shell (3) of thermoplastic material within and adjacent to said external shell, and also extending across and being bonded to said first and second metal caps along said entire inner walls, said internal shell having a neck portion extending partly into said bore of said second cap and terminating short of its outer end so that said internal shell is isolated from and does not extend to the exterior of said fluid tank, said internal shell (3) having been formed in a mold in which said first and second metal caps were pre-inserted so that said internal shell is molded against and bonded to said first and second metal caps.

3. Tank as in claim 2, characterized in that said inner wall has, in the zone covered by the internal shell (3), a recess (15) of a thickness corresponding substantially to the thickness of the shell (3).

4. Tank as in claim 2, characterized in that an annular band made of an elastomer material is interposed between the external shell (4) and at least one cap (10, 5) on an inclined surface (13) of the latter so as to reinforce the mechanical bond between these two elements and to permit a certain possibility of radial displacement of the external shell in relation to the cap.

5. Tank as in claim 2, characterized in that the filament winding is a cross winding comprising fibres wound in the two diagonal planes of the cylindrical tank (2) and fibres wound round the circumference.

6. A tank in accordance with claim 2 further comprising a layer of elastomer interposed between each of said metal caps and said external shell.

7. A tank in accordance with claim 2 wherein said outer shell comprises wound fiber reinforced epoxy resin and said thermoplastic of said inner shell is selected from the group consisting of polyamide, polyethylene and polypropylene.

8. A tank in accordance with claim 2 wherein an adhesive layer is located between said internal shell and said first and second metal caps.

9. A tank according to claim 8 wherein said adhesive comprises the same thermoplastic material from which said internal shell is formed.

10. A tank in accordance with claim 8 wherein said adhesive comprises a two-component adhesive composed of a mixture of phenolic epoxy resin and the thermoplastic material from which said internal shell is formed.

11. Tank as in claim 10, wherein said internal shell (3) comprises a polyamide and said two-component adhesive comprises a mixture of phenolic epoxy resin and polyamide.

12. Tank as in claim 11, characterized in that the two-component adhesive means is composed of a mixture of products known under the names "RILPRIM 204" and "RILSAN NATUREL ES4".

* * * * *